US009095887B2

(12) United States Patent
Tsuda et al.

(10) Patent No.: US 9,095,887 B2
(45) Date of Patent: Aug. 4, 2015

(54) ROLLER HEMMING DEVICE

(75) Inventors: Satoshi Tsuda, Toyota (JP); Tomonari Yasuda, Toyota (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 200 days.

(21) Appl. No.: 13/989,909

(22) PCT Filed: Nov. 29, 2010

(86) PCT No.: PCT/JP2010/071288

§ 371 (c)(1),
(2), (4) Date: May 28, 2013

(87) PCT Pub. No.: WO2012/073311

PCT Pub. Date: Jun. 7, 2012

(65) Prior Publication Data

US 2013/0247366 A1 Sep. 26, 2013

(51) Int. Cl.

| | |
|---|---|
| ***B21D 39/00*** | (2006.01) |
| ***B21D 39/18*** | (2006.01) |
| ***B23P 19/00*** | (2006.01) |
| ***B21B 39/20*** | (2006.01) |
| ***B21D 5/14*** | (2006.01) |
| ***B21D 39/02*** | (2006.01) |

(52) U.S. Cl.

CPC ..... *B21D 5/143* (2013.01); *B21D 39/023* (2013.01); *Y10T 29/53422* (2015.01)

(58) Field of Classification Search

CPC .... B21D 39/023; B21D 39/021; B21D 5/143; B21D 5/01; B21D 5/14; Y10T 29/53422; Y10T 29/53709; Y10T 29/49908; Y10T 29/49915; Y10T 29/49922; Y10T 29/49924; Y10T 29/49936

USPC ..... 29/505, 513, 509, 521, 796; 72/252.5

See application file for complete search history.

(56) References Cited

U.S. PATENT DOCUMENTS

| | | | | |
|---|---|---|---|---|
| 8,127,423 | B2 * | 3/2012 | Toeniskoetter et al. | 29/509 |
| 2002/0078730 | A1 | 6/2002 | Hatty | |
| 2009/0089995 | A1 * | 4/2009 | Toeniskoetter et al. | 29/463 |
| 2012/0260711 | A1 * | 10/2012 | Ikeda et al. | 72/252.5 |
| 2013/0276500 | A1 * | 10/2013 | Tsuda | 72/252.5 |

FOREIGN PATENT DOCUMENTS

| | | | | |
|---|---|---|---|---|
| GB | 2441709 | A * | 3/2008 | B21D 19/04 |
| JP | 5-305357 | A | 11/1993 | |
| JP | 7-314054 | A | 12/1995 | |
| JP | 11-254063 | A | 9/1999 | |
| JP | 2000061557 | A | 2/2000 | |
| JP | 2004517733 | A | 6/2004 | |
| JP | 2005349484 | A | 12/2005 | |
| JP | 2006341291 | A | 12/2006 | |

(Continued)

*Primary Examiner* — Essama Omgba

(74) *Attorney, Agent, or Firm* — Kenyon & Kenyon LLP

(57) ABSTRACT

A compact roller hemming device which can perform a hemming process with respect to various works. The roller hemming device for hemming a work includes rotary shafts rotating on axes thereof, and first lower dies and second lower dies on which the corresponding work is placed. The first lower dies and the second lower dies are arranged on outer circumferential parts of the rotary shafts at predetermined intervals. The rotary shafts rotate so that one each of the first lower dies and the second lower dies is selected depending on a type of the work to be hemmed.

4 Claims, 5 Drawing Sheets

(56) References Cited

FOREIGN PATENT DOCUMENTS

| | | | | | |
|---|---|---|---|---|---|
| JP | 2007014973 | A | | 1/2007 | |
| JP | 2008296322 | A | | 12/2008 | |
| JP | 2009018769 | A | | 1/2009 | |
| JP | 2010064211 | A | | 3/2010 | |
| WO | WO 2006137457 | A1 | * | 12/2006 | ..... B21D 19/04 |
| WO | WO 2012093494 | A1 | * | 7/2012 | ..... B21D 39/02 |

* cited by examiner

ROLLER HEMMING DEVICE

This is a 371 national phase application of PCT/JP2010/071288 filed 29 Nov. 2010, the contents of which are incorporated herein by reference.

FIELD OF THE INVENTION

The present invention relates to a roller hemming device for performing a hemming process with respect to a work by use of a roller.

BACKGROUND OF THE INVENTION

Conventionally, a roller hemming device is widely known that is configured to perform a hemming process, by use of a roller, with respect to a work such as a door subassembly of a car (for example, see Patent Literature 1).

The roller hemming device as mentioned above has a lower die on which the work is placed, and a processing device for hemming the work placed on the lower die by use of the roller.

When the roller hemming device performs the hemming process with respect to various works, the processing device can be widely used regardless of a type (shape, size and the like) of the work, whereas the lower die must be changed depending on a type of the work.

Therefore, the roller hemming device requires a space in which a plurality of lower dies depending on types of works are placed, which causes au increase in size of the roller hemming device.

CITATION LIST

Patent Literature

Patent Literature 1: JP H05-305357 A

SUMMARY OF INVENTION

Problem to Be Solved By the Invention

The objective of the present invention is to provide a compact roller hemming device capable of performing a hemming process with respect to various works.

Means for Solving the Problem

A first aspect of the invention is a roller hemming device for hemming various works each having a plurality of parts to be hemmed, which includes a pair of die changing devices for performing die-change depending on a type of the work, in which the pair of die changing devices is configured to move into and out of proximity with each other. Each of the pair of die changing devices includes a rotary shaft rotating on an axis thereof, and a plurality of lower dies each of which the corresponding one of the various works is placed on, in which each of the plurality of lower dies is formed according to a shape of the corresponding part to be hemmed of the work, the plurality of lower dies are arranged on an outer circumferential part of the rotary shaft at predetermined intervals, and the rotary shaft rotates so that one of the plurality of lower dies is selected depending on a type of the work to be hemmed. The selected lower die of said one die changing device and the selected lower die of the other die changing device are so arranged in accordance with the two parts to be hemmed of the work which are opposed to each other that the two parts to be hemmed of the work are hemmed in a same step.

A second aspect of the invention is a roller hemming device for hemming various works each having a plurality of parts to be hemmed, which includes a rotary shaft rotating on an axis thereof, and a plurality of lower dies each of which corresponding one of the various works is placed on, in which each of the plurality of lower dies is formed in a shape corresponding to all the parts to be hemmed of the corresponding work so as to come in contact with all the parts to be hemmed thereof, the plurality of lower dies are arranged on an outer circumferential part of the rotary shaft at predetermined intervals, the rotary shaft rotates so that one of the plurality of lower dies is selected depending on the type of the work to be hemmed, and all the parts to be hemmed of the work corresponding to the selected lower die are hemmed on the selected lower die in a same step.

Preferably, the roller hemming device further includes a positioning device for fixing the work at a predetermined position. The positioning device includes a rotary shaft rotating on an axis thereof, a plurality of positioning pins each of which is inserted into a positioning hole formed in the corresponding work, and an arm for moving the plurality of positioning pins to predetermined positions, in which the plurality of positioning pins are arranged on an outer circumferential part of the rotary shaft of the positioning device at predetermined intervals, the rotary shaft of the positioning device rotates so that one of the plurality of positioning pins is selected depending on the type of the work to be hemmed, and the arm inserts the selected positioning pin into the positioning hole of the work to be hemmed to fix the work.

Advantageously, the roller hemming device further includes a locking device for locking the rotary shaft at a predetermined rotational position. The locking device includes a locking pin formed in a bar, and an actuator for supporting the locking pin so that the locking pin extends from and retracts into the actuator, in which in a state where one of the plurality of lower dies is selected, the actuator inserts the locking pin into a locking hole formed in the rotary shaft to fix the rotary shaft.

Effects of the Invention

The present invention makes it possible to perform a hemming process with respect to various works even in a narrow space.

DETAILED DESCRIPTION

First Embodiment

Figure 1:
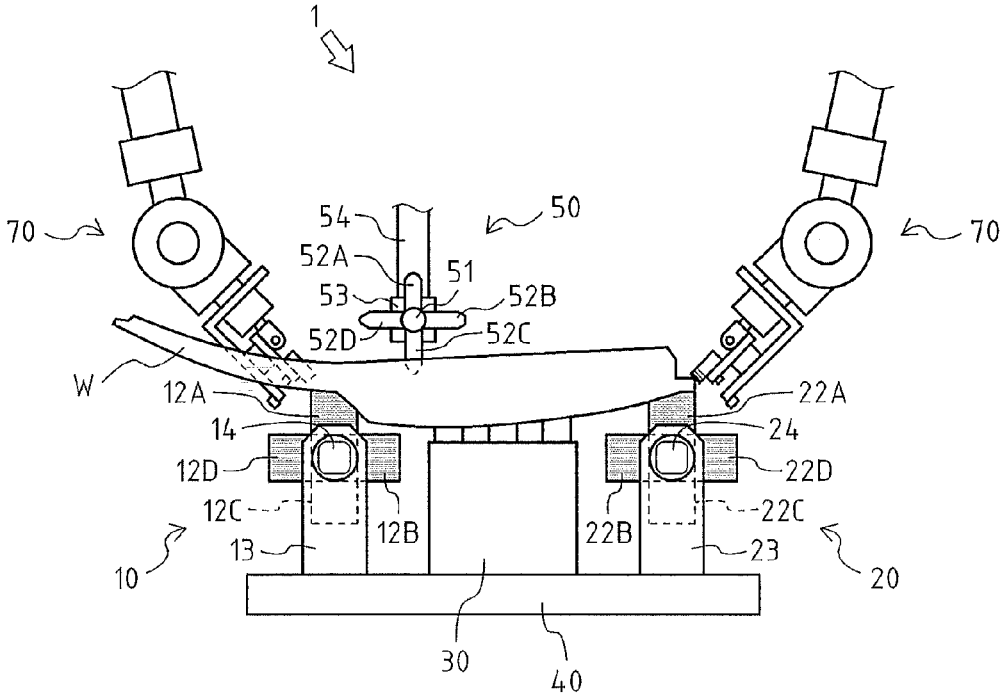
FIG. 1 shows a roller hemming device according to a first embodiment of the present invention.
Figure 2:
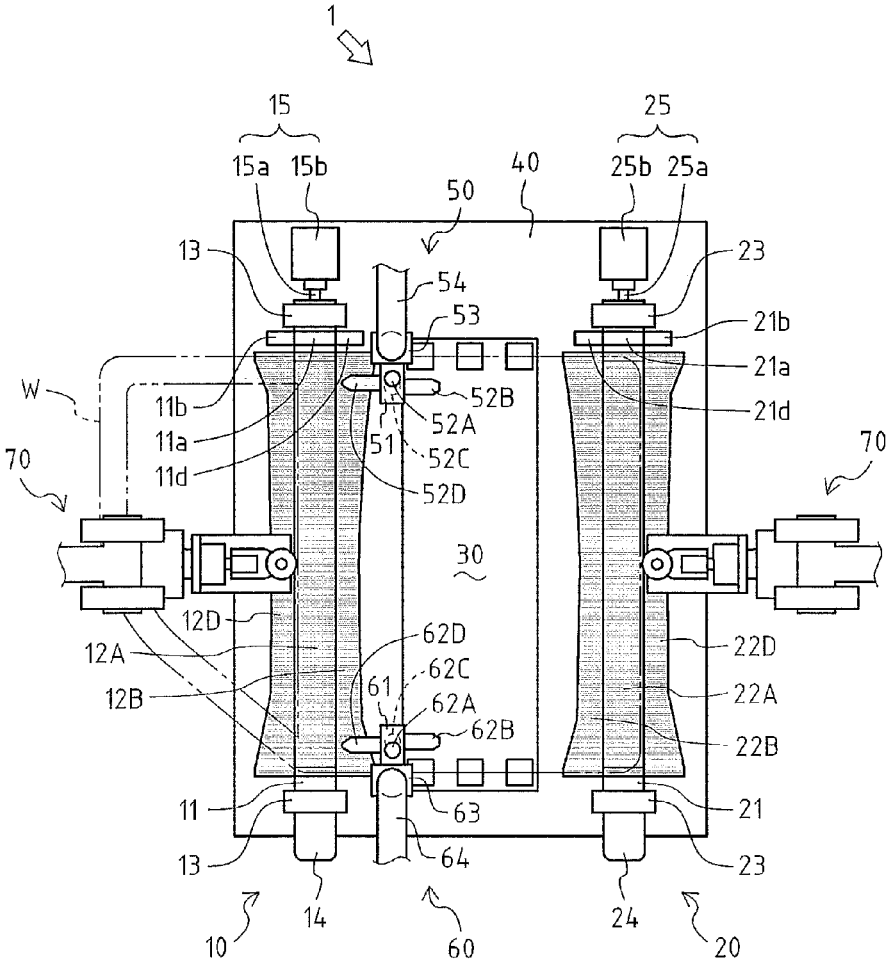
FIG. 2 is a top view of the roller hemming device according to the first embodiment of the present invention.
Figure 3:
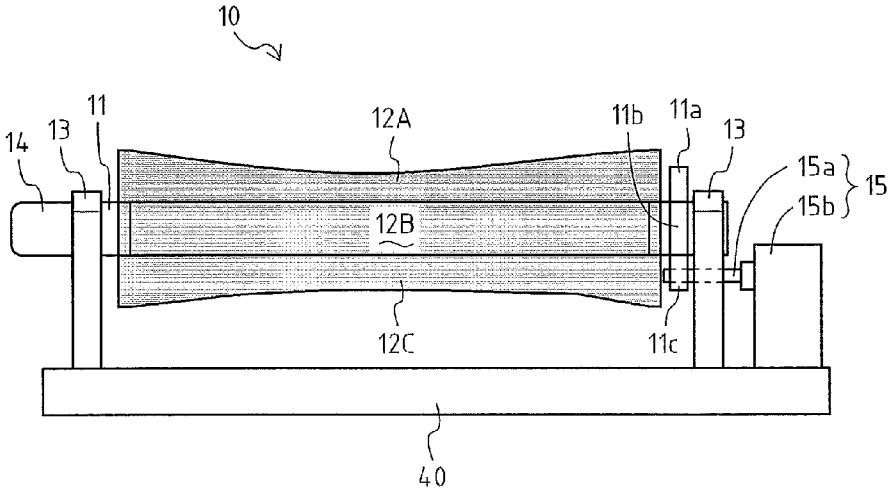
FIG. 3 is a side view of one die changing device according to the first embodiment of the present invention.

With reference to FIGS. 1 to 3, a roller hemming device 1 as a first embodiment of a roller hemming device according to the present invention is described below.

The roller hemming device 1 is a device for performing a hemming process with respect to various works W.

The work W is a subject to be hemmed by the roller hemming device 1, and is a front-door subassembly fabricated in a step for manufacturing cars.

Note that a top-bottom direction and a right-left direction in FIG. 1 are defined as a top-bottom direction and a right-left direction of the roller hemming device 1, respectively. Additionally, this side in FIG. 1 is defined as a front of the roller hemming device 1, and the far side in FIG. 1 is defined as a rear of the roller hemming device 1.

As shown in FIGS. 1 and 2, the roller hemming device 1 has die changing devices 10, 20 for changing lower dies depending on the type of the work W, a middle supporter 30 for supporting the middle in the right-left direction of the work W, a base 40 on which the die changing devices 10, 20 and the middle supporter 30 are provided, positioning devices 50, 60 for fixing the work W at a predetermined position, and two processing devices 70 for hemming the work W.

The die changing device 10 has a rotary shaft 11 rotating on the axis thereof, lower dies 12A, 12B, 12C, 12D provided on the outer circumferential part of the rotary shaft 11, a pair of supporting plates 13 for supporting the rotary shaft 11, a motor 14 for rotating the rotary shaft 11, and a locking device 15 for locking the rotary shaft 11 at a predetermined rotational position.

The rotary shaft 11 is a shaft extending in the front-rear direction, and can rotate on the axis thereof.

The lower dies 12A, 12B, 12C, 12D are members each of which the work W of the corresponding type (shape, size and the like) is placed on. In other words, each of the lower dies 12A, 12B, 12C, 12D is formed so as to have the shape, size and the like corresponding to the type of the work W to be placed thereon.

The lower dies 12A, 12B, 12C, 12D are available for four types of works W when combined with after-mentioned lower dies 22A, 22B, 22C, 22D of the die changing device 20, respectively. In other words, the lower die 12A and the lower die 22A, the lower die 12B and the lower die 22B, the lower die 12C and the lower die 22C, or the lower die 12D and the lower die 22D are used in pairs. The lower dies 12A, 12B, 12C, 12D are provided from the vicinity of the front end to the vicinity of the rear end of the rotary shaft 11, and are arranged at equal intervals in a clockwise direction as seen from the front in the mentioned order.

In the present embodiment, each of the lower dies 12A, 12B, 12C, 12D is formed according to the shape of the end part (the part contacting with the lower die 12A in FIGS. 1 and 2) on the beltline side of the corresponding work W so that the end part on the beltline side may be placed thereon.

As shown in FIG. 3, the supporting plates 13 are plates extending in the top-bottom direction, and the upper parts thereof support the rotary shaft 11 in a rotatable manner. Specifically, the rotary shaft 11 penetrates through both the surfaces of each supporting plate 13, and the supporting plates 13 are arranged at the respective end parts of the rotary shaft 11. The supporting plates 13 are provided on the base 40, and are configured to be moved into and out of proximity with after-mentioned supporting plates 23 of the die changing device 20 in the right-left direction by a predetermined actuator (not shown) such as an air cylinder.

Note that FIG. 3 shows only the die changing device 10 and the base 40 for the purpose of description.

The motor 14 is a servomotor for rotating the rotary shaft 11 on the axis thereof, and is fixed to the front end part of the rotary shaft 11. The motor 14 is controlled so that a lower die, corresponding to the type of the work W to be hemmed, of the lower dies 12A, 12B, 12C, 12D provided on the rotary shaft 11 stops on the upper side. In other words, the motor 14 can select one of the lower dies 12A, 12B, 12C, 12D provided on the rotary shaft 11 depending on the type of the work W. The motor 14 is controlled so that each of the lower dies 12A, 12B, 12C, 12D moves to the upper side through the shortest path. For example, when the lower die 12A changes to the lower die 12D, the motor 14 rotates the rotary shaft 11 clockwise as seen from the front, and when the lower die 12B changes to the lower die 12C, the motor 14 rotates the rotary shaft 11 counterclockwise as seen from the front.

The locking device 15 has a locking pin 15*a* formed in a bar, and an air cylinder 15*b* supporting the locking pin 15*a* so that the locking pin 15*a* can extend from and retract into the air cylinder 15*b*.

The locking pin 15*a* is a bar extending in the front-rear direction.

In accordance with the position of the locking pin 15*a*, a through hole is formed so as to penetrate through the rear supporting plate 13 in the front-rear direction. Since the through hole has a slightly larger inner diameter than the outer diameter of the locking pin 15*a*, the locking pin 15*a* can penetrate through the rear supporting plate 13.

The rotary shaft 11 has locking parts 11*a*, 11*b*, 11*c*, 11*d* fixed between the part of the rotary shaft 11 supported by the rear supporting plate 13 and the part of the rotary shaft 11 on which the lower dies 12A, 12B, 12C, 12D are provided, and the locking parts 11*a*, 11*b*, 11*c*, 11*d* are formed to project toward the radial outside of the rotary shaft 11. The locking parts 11*a*, 11*b*, 11*c*, 11*d* are arranged at equal intervals in accordance with the positions of the lower dies 12A, 12B, 12C, 12D on the rotary shaft 11. Each of the locking parts 11*a*, 11*b*, 11*c*, 11*d* has a locking hole penetrating therethrough in the front-rear direction, and the locking hole of the locking part positioned on the lower side by the rotation of the rotary shaft 11 is formed in accordance with the position of the locking pin 15*a*. Since each locking hole has an inner diameter substantially equal to the outer diameter of the locking pin 15*a*, the locking pin 15*a* can insert into the locking hole.

The air cylinder 15*b* is an actuator which moves the locking pin 15*a* in the front-rear direction by charging and discharging compressed air, and supports the rear end part of the locking pin 15*a*.

Thus, in the locking device 15, when the air cylinder 15*b* moves the locking pin 15*a* toward the front with any one of the lower dies 12A, 12B, 12C, 12D positioned on the upper side, namely, with any one of the locking parts 11*a*, 11*b*, 11*c*, 11*d* positioned on the lower side, the locking pin 15*a* enters into the locking hole of the locking part positioned on the lower side of the locking parts 11*a*, 11*b*, 11*c*, 11*d* through the through hole of the rear supporting plate 13. For example, when the lower die 12B is positioned on the upper side, the locking pin 15*a* enters into the locking hole of the locking part 11*d*.

This makes it possible to certainly lock the rotary shaft 11 with any one of the lower dies 12A, 12B, 12C, 12D positioned on the upper side. Therefore, it is possible to reduce an error of a rotational position where the rotary shaft 11 stops, and to prevent the rotary shaft 11 from rotating, for example, under the weight of the lower dies 12A, 12B, 12C, 12D when a contingency such as a stop of the motor 14 occurs. Moreover, it is possible to reduce a load applied on the shaft of the motor 14 at all times.

As shown in FIGS. 1 and 2, the die changing device 20 is substantially similar in structure to the die changing device 10. The die changing device 20 has a rotary shaft 21 rotating on the axis thereof, the lower dies 22A, 22B, 22C, 22D provided on the outer circumferential part of the rotary shaft 21, a pair of supporting plates 23 for supporting the rotary shaft 21, a motor 24 for rotating the rotary shaft 21, and a locking device 25 for locking the rotary shaft 21 at a predetermined rotational position.

The rotary shaft 21 is a shaft extending in the front-rear direction, and can rotate on the axis thereof.

The lower dies 22A, 22B, 22C, 22D are members each of which the work W of the corresponding type (shape, size and the like) is placed on. The lower dies 22A, 22B, 22C, 22D are available for four types of works W when combined with the lower dies 12A, 12B, 12C, 12D of the die changing device 10, respectively. In other words, the lower die 12A and the lower die 22A, the lower die 12B and the lower die 22B, the lower die 12C and the lower die 22C, or the lower die 12D and the lower die 22D are used in pairs. The lower dies 22A, 22B, 22C, 22D are provided from the vicinity of the front end to the vicinity of the rear end of the rotary shaft 21, and are arranged at equal intervals in a counterclockwise direction as seen from the front in the mentioned order.

In the present embodiment, each of the lower dies 22A, 22B, 22C, 22D is formed according to the shape of the end part (the part contacting with the lower die 22A in FIGS. 1 and 2) on the rocker-panel side of the corresponding work W so that the end part on the rocker-panel side may be placed thereon. Thus, each of the lower dies 22A, 22B, 22C, 22D is configured to support the end part of the work W on the rocker-panel side, and each of the lower dies 12A, 12B, 12C, 12D as mentioned above is configured to support the end part of the work W on the beltline side. Thereby, both the end parts of the work W in the right-left direction are supported from below.

The supporting plates 23 are plates extending in the top-bottom direction, and the upper parts thereof support the rotary shaft 21 in a rotatable manner. Specifically, the rotary shaft 21 penetrates through both the surfaces of each supporting plate 23, and the supporting plates 23 are arranged at both the end parts of the rotary shaft 21. The supporting plates 23 are provided on the base 40, and are configured to be moved into and out of proximity with the supporting plates 13 of the die changing device 10 in the right-left direction by a predetermined actuator (not shown) such as an air cylinder.

The motor 24 is a servomotor for rotating the rotary shaft 21 on the axis thereof, and is fixed to the front end part of the rotary shaft 21. The motor 24 is controlled so that a lower die, corresponding to the type of the work W to be hemmed, of the lower dies 22A, 22B, 22C, 22D provided on the rotary shaft 21 stops on the upper side. In other words, the motor 24 selects one of the lower dies 22A, 22B, 22C, 22D provided on the rotary shaft 21 depending on the type of the work W. The motor 24 is controlled so that each of the lower dies 22A, 22B, 22C, 22D moves to the upper side through the shortest path. For example, when the lower die 22A changes to the lower die 22D, the motor 24 rotates the rotary shaft 21 counterclockwise as seen from the front, and when the lower die 22B changes to the lower die 22C, the motor 24 rotates the rotary shaft 21 clockwise as seen from the front.

The locking device 25 is substantially similar in structure to the locking device 15. The locking device 25 has a locking pin 25*a* formed in a bar, and an air cylinder 25*b* supporting the locking pin 25*a* so that the locking pin 25*a* can extend from and retract into the air cylinder 25*b*.

In the locking device 25, when the air cylinder 25*b* moves the locking pin 25*a* toward the front with any one of the lower dies 22A, 22B, 22C, 22D positioned on the upper side, namely, with any one of locking parts 21*a*, 21*b*, 21*c*, 21*d* positioned on the lower side, the locking pin 25*a* enters into a locking hole of the locking part positioned on the lower side of the locking parts 21*a*, 21*b*, 21*c*, 21*d* through a through hole of the rear supporting plate 23. For example, when the lower die 22B is positioned on the upper side, the locking pin 25*a* enters into the locking hole of the locking part 21*d*.

This makes it possible to certainly lock the rotary shaft 21 with any one of the lower dies 22A, 22B, 22C, 22D positioned on the upper side. Therefore, it is possible to reduce an error of a rotational position where the rotary shaft 21 stops, and to prevent the rotary shaft 21 from rotating, for example, under the weight of the lower dies 22A, 22B, 22C, 22D when a contingency such as a stop of the motor 24 occurs.

Note that since the through hole of the rear supporting plate 23 is substantially similar in structure to the through hole of the rear supporting plate 13, and the locking parts 21*a*, 21*b*, 21*c*, 21*d* are substantially similar in structure to the locking parts 11*a*, 11*b*, 11*c*, 11*d*, detailed descriptions thereof are omitted. The illustration of the locking part 21*c* is omitted.

The middle supporter 30 supports the middle in the right-left direction of the work W from below. The middle supporter 30 is provided on the base 40, and is arranged between the die changing devices 10, 20.

The base 40 is a stand on which the die changing devices 10, 20 and the middle supporter 30 are provided.

The positioning device 50 has a rotary shaft 51 rotating on the axis thereof, positioning pins 52A, 52B, 52C, 52D provided on the outer circumferential surface of the rotary shaft 51, a supporting member 53 for supporting the rotary shaft 51, and an arm 54 connected to the supporting member 53.

The rotary shaft 51 is a shaft extending in the front-rear direction, and is configured to be rotated on the axis thereof by a predetermined driving device (not shown).

The positioning pins 52A, 52B, 52C, 52D are bars extending toward the radial outside of the rotary shaft 51. The positioning pins 52A, 52B, 52C, 52D are provided on the outer circumferential surface of the rotary shaft 51, and are arranged at equal intervals in a clockwise direction as seen from the front. The shape and position of each of the positioning pins 52A, 52B, 52C, 52D are set depending on a type of the work W. One of the positioning pins 52A, 52B, 52C, 52D enters into a first positioning hole formed on the top face (inner panel) of the work W, and thereby the work W is located at a proper position. In other words, the positioning pins 52A, 52B, 52C, 52D are available for four types of works W.

On the top face (inner panel) of the work W, the first positioning hole for the positioning of the work W is formed, and the shape and position thereof differ depending on a type of the work W. Therefore, one of the positioning pins 52A, 52B, 52C, 52D is used depending on the type of the first positioning hole of the work W. In the present embodiment, the first positioning hole is arranged in the vicinity of the rear end part of the work W.

The supporting member 53 supports the rotary shaft 51 in a rotatable manner, and is connected to the rear end part of the rotary shaft 51. The upper part of the supporting member 53 is attached to the arm 54.

The arm 54 is connected to the supporting member 53, and is configured to be moved in the top-bottom direction by an actuator such as an air cylinder and a hydraulic cylinder. Therefore, the positioning pins 52A, 52B, 52C, 52D move in the top-bottom direction depending on the movement of the arm 54. In other words, the arm 54 can move the positioning pins 52A, 52B, 52C, 52D to predetermined positions.

Thus, in the positioning device 50, the arm 54 moves downward after the rotary shaft 51 is rotated by the driving device so that a positioning pin, corresponding to the type of the work W to be hemmed, of the positioning pins 52A, 52B, 52C, 52D is positioned on the lower side, and thereby the positioning pin on the lower side of the positioning pins 52A, 52B, 52C, 52D enters into the first positioning hole.

This makes it possible to easily select one of the positioning pins 52A, 52B, 52C, 52D depending on the type of the work W.

In the present embodiment, the four positioning pins 52A, 52B, 52C, 52D are provided on the rotary shaft 51, but the number of positioning pins may be changed depending on the number of types of works W.

The positioning device 60 is substantially similar in structure to the positioning device 50. The positioning device 60 has a rotary shaft 61 rotating on the axis thereof, positioning pins 62A, 62B, 62C, 62D provided on the outer circumferential surface of the rotary shaft 61, a supporting member 63 for supporting the rotary shaft 61, and an arm 64 connected to the supporting member 63.

The rotary shaft 61 is a shaft extending in the front-rear direction, and is configured to be rotated on the axis thereof by a predetermined driving device (not shown).

The positioning pins 62A, 62B, 62C, 62D are bars extending toward the radial outside of the rotary shaft 61. The positioning pins 62A, 62B, 62C, 62D are provided on the outer circumferential surface of the rotary shaft 61, and are arranged at equal intervals in a counterclockwise direction as seen from the rear. The shape and position of each of the positioning pins 62A, 62B, 62C, 62D are set depending on a type of the work W. One of the positioning pins 62A, 62B, 62C, 62D enters into a second positioning hole formed on the top face (inner panel) of the work W, and thereby the work W is located at a proper position. In other words, the positioning pins 62A, 62B, 62C, 62D are available for four types of works W.

On the top face (inner panel) of the work W, the second positioning hole for the positioning of the work W is formed similarly to the first positioning hole as mentioned above, and the shape and position thereof differ depending on a type of the work W. Therefore, one of the positioning pins 62A, 62B, 62C, 62D is used depending on the type of the second positioning hole of the work W. In the present embodiment, the second positioning hole is arranged in the vicinity of the front end part of the work W.

The supporting member 63 supports the rotary shaft 61 in a rotatable manner, and is connected to the front end part of the rotary shaft 61. The upper part of the supporting member 63 is attached to the arm 64.

The arm 64 is connected to the supporting member 63, and is configured to be moved in the top-bottom direction by an actuator such as an air cylinder and a hydraulic cylinder. Therefore, the positioning pins 62A, 62B, 62C, 62D move in the top-bottom direction depending on the movement of the arm 64. In other words, the arm 64 can move the positioning pins 62A, 62B, 62C, 62D to predetermined positions.

Thus, in the positioning device 60, the arm 64 moves downward after the rotary shaft 61 is rotated by the driving device so that a positioning pin, corresponding to the type of the work W to be hemmed, of the positioning pins 62A, 62B, 62C, 62D is positioned on the lower side, and thereby the positioning pin on the lower side of the positioning pins 62A, 62B, 62C, 62D enters into the second positioning hole.

This makes it possible to easily select one of the positioning pins 62A, 62B, 62C, 62D depending on the type of the work W. Therefore, it is possible to easily position the work W at a proper position by use of the positioning pins 52A, 52B, 52C, 52D and the positioning pins 62A, 62B, 62C, 62D.

In the present embodiment, the four positioning pins 62A, 62B, 62C, 62D are provided on the rotary shaft 61, but the number of positioning pins may be changed depending on the number of types of works W.

The processing device 70 is a device for hemming the work W placed on a pair of lower dies in the die changing device 10 and the die changing device 20. The processing device 70 has a roller, and performs the hemming process by rolling the roller on the outer peripheral part of the work W. In the present embodiment, two processing devices 70 are provided, one processing devices 70 (a left processing device 70 in FIGS. 1 and 2) hemming the end part (the part placed on any one of the lower dies 12A, 12B, 12C, 12D) on the beltline side of the work W, the other processing device 70 (a right processing device 70 in FIGS. 1 and 2) hemming the end part (the part placed on any one of the lower dies 22A, 22B, 22C, 22D) on the rocker-panel side of the work W.

As mentioned above, in the roller hemming device 1, the motor 14 rotates the rotary shaft 11 on which the lower dies 12A, 12B, 12C, 12D are provided, and stops a lower die, corresponding to the type of the work W to be hemmed, of the lower dies 12A, 12B, 12C, 12D on the upper side. Additionally, the motor 24 rotates the rotary shaft 21 on which the lower dies 22A, 22B, 22C, 22D are provided, and stops a lower die, corresponding to the type of the work W to be hemmed, of the lower dies 22A, 22B, 22C, 22D on the upper side. Moreover, depending on the size of the work W, the supporting plates 13 and the supporting plates 23 move into and out of proximity with each other in the right-left direction.

This makes it possible to easily change any one of the lower dies 12A, 12B, 12C, 12D to another one, and to easily change any one of the lower dies 22A, 22B, 22C, 22D to another one depending on the type of the work W even in a narrow space. Therefore, it becomes possible to downsize the roller hemming device 1.

After a pair of lower dies corresponding to the type of the work W to be hemmed is selected from the lower dies 12A, 12B, 12C, 12D of the die changing device 10 and the lower dies 22A, 22B, 22C, 22D of the die changing device 20, the work W is placed on the pair of lower dies so that the end part on the beltline side of the work W comes in contact with the lower die selected from the lower dies 12A, 12B, 12C, 12D and that the end part on the rocker-panel side of the work W comes in contact with the lower die selected from the lower dies 22A, 22B, 22C, 22D. Then, after the positioning devices 50, 60 position the work W at a proper position, the two processing devices 70 hem the end parts on the beltline side and the rocker-panel side of the work W.

The work W whose end parts on the beltline side and the rocker-panel side are hemmed by the roller hemming device 1 is conveyed to another roller hemming device substantially similar in structure to the roller hemming device 1, and the roller hemming device hems the front and rear end parts of the work W. In other words, The work W passes through a first step in which the roller hemming device 1 hems two parts to be hemmed, the end parts on the beltline side and the rocker-panel side, and a second step in which another roller hemming device hems two parts to be hemmed, the front and rear end parts, and thereby a total of four parts to be hemmed, namely, the whole outer peripheral part of the work W is hemmed.

Note that since another roller hemming device is substantially similar in structure to the roller hemming device 1 except two lower dies on which the front and rear end parts of the work W are placed are provided instead of the lower dies 12A, 12B, 12C, 12D and the lower dies 22A, 22B, 22C, 22D on which the end parts on the beltline side and the rocker-panel side of the work W are placed, a detailed description thereof is omitted.

In the present embodiment, the die changing devices 10, 20 are configured so that the motors 14, 24 can select a pair of lower dies from the lower dies 12A, 12B, 12C, 12D and the lower dies 22A, 22B, 22C, 22D. However, the die changing devices 10, 20 may be configured so that gears provided instead of the motors 14, 24 can stop one each of the lower dies 12A, 12B, 12C, 12D and the lower dies 22A, 22B, 22C, 22D at a predetermined position.

In the present embodiment, the lower dies 12A, 12B, 12C, 12D and the lower dies 22A, 22B, 22C, 22D are provided on the rotary shafts 11, 21, respectively. However, depending on the number of types of works W, the number of lower dies may be changed.

In the present embodiment, the work W is a front-door subassembly, but even in a case where the work W is another subassembly (for example, back-door subassembly, hood subassembly, and luggage-compartment subassembly), the work W is hemmed by two roller hemming devices. For example, in the case where the work W is a back-door subassembly, the work W passes through a first step in which one roller hemming device hems the end parts of the work W on the right and left side with respect to a direction of forward movement of a car, and a second step in which the other roller hemming device hems the end parts on the rocker-panel side and the roof side of the work W, and thereby the whole outer peripheral part of the work W is hemmed.

Second Embodiment

Figure 4:
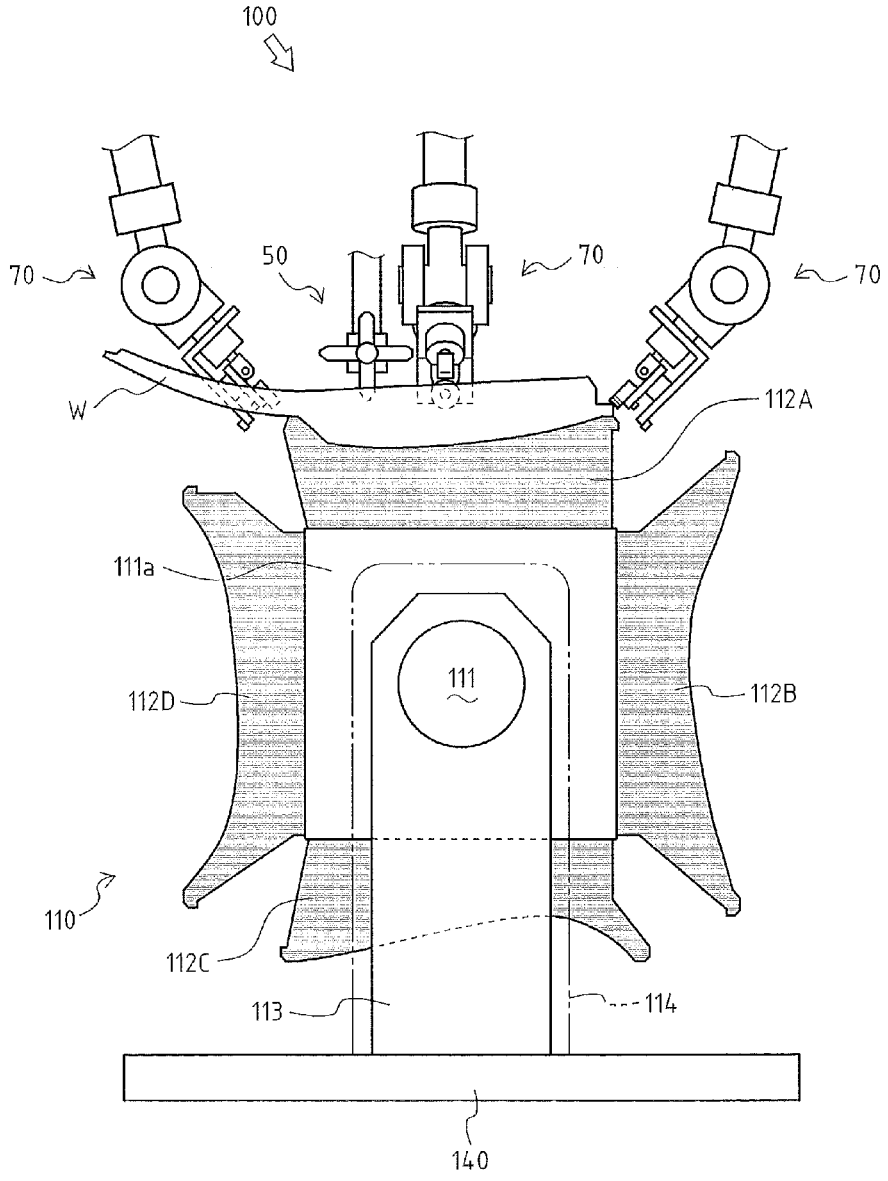
FIG. 4 shows a roller hemming device according to a second embodiment of the present invention.
Figure 5:
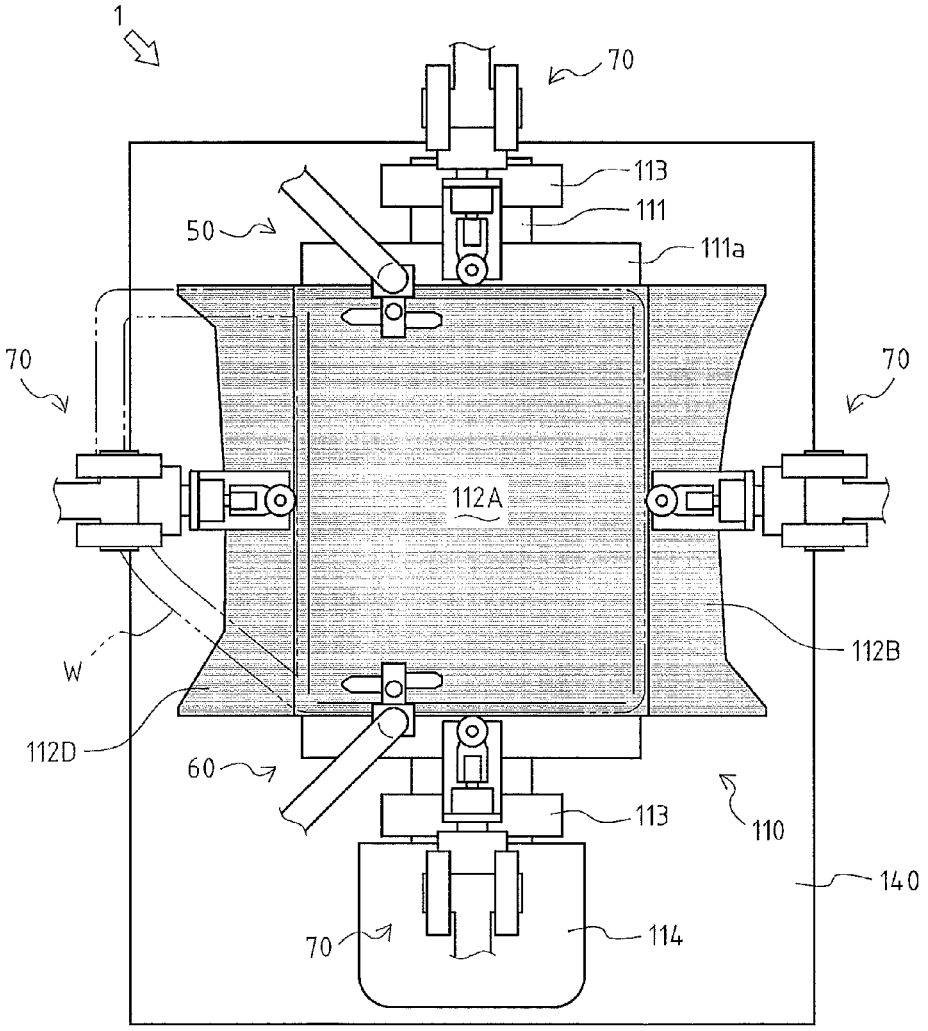
FIG. 5 is a top view of the roller hemming device according to the second embodiment of the present invention.

With reference to FIGS. 4 and 5, a roller hemming device 100 as a second embodiment of a roller hemming device according to the present invention is described below.

The roller hemming device 100 is a device for performing a hemming process with respect to the various works W.

Note that a top-bottom direction and a right-left direction in FIG. 4 are defined as a top-bottom direction and a right-left direction of the roller hemming device 100, respectively. Additionally, this side in FIG. 4 is defined as a front of the roller hemming device 100, and the far side in FIG. 4 is defined as a rear of the roller hemming device 100.

The parts common to the roller hemming device 1 and the roller hemming device 100 are indicated by same reference signs, and descriptions thereof are hereinafter omitted.

As shown in FIGS. 4 and 5, the roller hemming device 100 has a die changing device 110 for changing lower dies depending on the type of the work W, a base 140 on which the die changing device 110 are provided, the positioning devices 50, 60 for fixing the work W at a predetermined position, and the four processing devices 70 for hemming the work W.

The die changing device 110 has a rotary shaft 111 rotating on the axis thereof, lower dies 112A, 112B, 112C, 112D provided on the outer circumferential part of the rotary shaft 111, a pair of supporting plates 113 for supporting the rotary shaft 111, and a motor 114 for rotating the rotary shaft 111.

The rotary shaft 111 is a shaft extending in the front-rear direction, and can rotate on the axis thereof. On the middle part of the rotary shaft 111, an attached part 111*a* to which the lower dies 112A, 112B, 112C, 112D are attached is fixed.

The attached part 111*a* is provided from the middle part to the vicinities of both the end parts of the rotary shaft 111, and is formed in substantially a cube. The lower dies 112A, 112B, 112C, 112D are arranged, clockwise as seen from the front, on the respective four surfaces of the attached part 111*a* continuing in the circumferential direction of the rotary shaft 111.

The lower dies 112A, 112B, 112C, 112D are members each of which the work W of the corresponding type (shape, size and the like) is placed on. The lower dies 112A, 112B, 112C, 112D are arranged at equal intervals since the lower dies 112A, 112B, 112C, 112D are provide on the continuing four surfaces of the attached part 111*a* of the rotary shaft 111. The lower dies 112A, 112B, 112C, 112D are configured to, without combining with another lower die, come in contact with the whole outer peripheral part (end parts on the beltline side, rocker-panel side, front side and rear side) of the work W unlike the lower dies 12A, 12B, 12C, 12D and the lower dies 22A, 22B, 22C, 22D. In other words, the lower dies according to the first embodiment correspond to the pieces made by dividing each of the lower dies 112A, 112B, 112C, 112D for each of the portions in contact with the respective end parts on the beltline side, rocker-panel side, front side and rear side of the work W.

The supporting plates 113 are plates extending upward from the base 140, and the upper parts thereof support the rotary shaft 111 in a rotatable manner. Specifically, the rotary shaft 111 penetrates through both the surfaces of each supporting plate 113, and the supporting plates 113 are arranged at the respective end parts of the rotary shaft 111.

The motor 114 is a servomotor for rotating the rotary shaft 111 on the axis thereof. The motor 114 is provided on the base 140, and is fixed to the front end part of the rotary shaft 111. The motor 114 is controlled so that a lower die, corresponding to the type of the work W to be hemmed, of the lower dies 112A, 112B, 112C, 112D provided on the rotary shaft 111 stops on the upper side. In other words, the motor 114 can select one of the lower dies 112A, 112B, 112C, 112D provided on the rotary shaft 111 depending on the type of the work W. The motor 114 is controlled so that each of the lower dies 112A, 112B, 112C, 112D moves to the upper side through the shortest path. For example, when the lower die 112A changes to the lower die 112D, the motor 114 rotates the rotary shaft 111 clockwise as seen from the front, and when the lower die 112B changes to the lower die 112C, the motor 114 rotates the rotary shaft 111 counterclockwise as seen from the front.

The base 140 is a stand on which the die changing device 110 is provided. Specifically, the supporting plates 113 and the motor 114 of the die changing device 110 are fixed to the base 140.

In the present embodiment, the four processing devices 70 are arranged in the vicinity of the end part on the beltline side, the vicinity of the end part on the rocker-panel side, the vicinity of the end part on the front side, and the vicinity of the end part on the rear side of the work W.

As mentioned above, in the roller hemming device 100, the motor 114 rotates the rotary shaft 111 on which the lower dies 112A, 112B, 112C, 112D are provided, and stops a lower die, corresponding to the type of the work W to be hemmed, of the lower dies 112A, 112B; 112C, 112D on the upper side.

This makes it possible to easily change any one of the lower dies 112A, 112B, 112C, 112D to another one depending on the type of the work W even in a narrow space. Therefore, it becomes possible to downsize the roller hemming device 100.

After a lower die corresponding to the type of the work W to be hemmed is selected from the lower dies 112A, 112B, 112C, 112D of the die changing device 110, the work W is placed on the selected lower die so that the outer peripheral part of the work W comes in contact with the selected lower die. Then, after the positioning devices 50, 60 position the work W at a proper position, the four processing devices 70 hem the whole outer peripheral part (end parts on the beltline side, rocker-panel side, front side and rear side) of the work W.

In the present embodiment, the roller hemming device 100 may hem the whole outer peripheral part of the work W in one step, thus enabling to reduce the time to hem the work W.

The roller hemming device 100 may be provided with a locking device configured similarly to the locking device 15 of the roller hemming device 1 to reduce an error of a rotational position where the rotary shaft 111 stops, and to prevent the rotary shaft 111 from rotating.

The roller hemming device 100 may be provided, instead of the locking device, with a member configured to be contacted with a movable part such as the attached part 111*a* of the rotary shaft 111, and the lower dies 112A, 112B, 112C, 112D by an actuator such as an air cylinder to certainly fix the rotary shaft 111 at a predetermined rotational position.

In the present embodiment, the die changing device 110 is configured so that the motor 114 can select one of the lower dies 112A, 112B, 112C, 112D. However, the die changing device 110 may be configured so that gears provided instead of the motor 114 can stop any one of the lower dies 112A, 112B, 112C, 112D at a predetermined position.

In the present embodiment, the four lower dies 112A, 112B, 112C, 112D are provided on the rotary shaft 111, but depending on the number of types of works W, the number of lower dies may be changed. Specifically, in the present embodiment, the attached part 111*a* of the rotary shaft 111 is formed in a cube with a square shape as seen from the front, but may be formed in a polygonal column with a polygonal shape as seen from the front. In this case, a plurality of lower dies are provided on the surface of the attached part 111*a* so as to be arranged in the respective sides of the polygonal shape.

INDUSTRIAL APPLICABILITY

The present invention is applied to a roller hemming device for hemming a plurality of types of works.

REFERENCE SIGNS LIST

1: roller hemming device
10, 20: die changing device
11, 21: rotary shaft
12A, 12B, 12C, 12D, 22A, 22B, 22C, 22D: lower die
13, 23: supporting plate
14, 24: motor
15, 25: locking device
30: middle supporter
40: base
50, 60: positioning device
51, 61: rotary shaft
52A, 52B, 52C, 52D, 62A, 62B, 62C, 62D: positioning pin
53, 63: supporting member
54, 64: arm
70: processing device

The invention claimed is:

1. A roller hemming device for hemming various works each having a plurality of parts to be hemmed, a work comprising:
- a pair of die changing devices for performing die-change depending on a type of the work,
- wherein the pair of die changing devices is configured to move into and out of proximity with each other,
- each of the pair of die changing devices comprises:
  - a rotary shaft rotating on an axis thereof; and
  - a plurality of lower dies, on each of which the corresponding one of the various works is placed,
- wherein each of the plurality of lower dies is formed according to a shape of the corresponding part of the work to be hemmed,
- the plurality of lower dies are arranged on an outer circumferential part of the rotary shaft at predetermined intervals,
- the rotary shaft rotates so that one of the plurality of lower dies is selected depending on a type of the work to be hemmed, and
- the selected lower die of said one die changing device and the selected lower die of the other die changing device are arranged in accordance with the two parts of the work to be hemmed which are opposed to each other so that the two parts of the work to be hemmed are hemmed in a same step.

2. The roller hemming device according to claim 1, further comprising:
- a positioning device for fixing the work at a predetermined position,
- wherein the positioning device comprises:
  - a rotary shaft rotating on an axis thereof;
  - a plurality of positioning pins each of which is inserted into a positioning hole formed in the corresponding work; and
  - an arm for moving the plurality of positioning pins to predetermined positions, wherein the plurality of positioning pins are arranged on an outer circumferential part of the rotary shaft of the positioning device at predetermined intervals,
- the rotary shaft of the positioning device rotates so that one of the plurality of positioning pins is selected depending on the type of the work to be hemmed, and
- the arm inserts the selected positioning pin into the positioning hole of the work to be hemmed to fix the work.

3. The roller hemming device according to claim 1, further comprising:
- a locking device for locking the rotary shaft at a predetermined rotational position, wherein the locking device comprises:
  - a locking pin formed in a bar; and
  - an actuator for supporting the locking pin so that the locking pin extends from and retracts into the actuator,
- wherein in a state where one of the plurality of lower dies is selected, the actuator inserts the locking pin into a locking hole formed in the rotary shaft to fix the rotary shaft.

4. A roller hemming device for hemming various works each having a plurality of parts to be hemmed, comprising:
- a rotary shaft rotating on an axis thereof; and
- a plurality of lower dies, on each of which the corresponding one of the various works is placed,
- wherein each of the plurality of lower dies is formed according to a shape of the corresponding work so as to come in contact with all the parts of the corresponding work to be hemmed,
- the plurality of lower dies are arranged on an outer circumferential part of the rotary shaft at predetermined intervals,
- the rotary shaft rotates so that one of the plurality of lower dies is selected depending on a type of the work to be hemmed, and all the parts of the work to be hemmed corresponding to the selected lower die are hemmed on the selected lower die in a same step.

* * * * *